US011168675B2

(12) United States Patent
Nassif

(10) Patent No.: US 11,168,675 B2
(45) Date of Patent: Nov. 9, 2021

(54) MOTOR VEHICLE PUMP ARRANGEMENT

(71) Applicant: Dr. Ing. h.c. F. Porsche Aktiengesellschaft, Stuttgart (DE)

(72) Inventor: Serge Nassif, Offendorf (FR)

(73) Assignee: Dr. Ing. h.c. F. Porsche Aktiengesellschaft

( * ) Notice: Subject to any disclaimer, the term of this patent is extended or adjusted under 35 U.S.C. 154(b) by 125 days.

(21) Appl. No.: 16/418,138

(22) Filed: May 21, 2019

(65) Prior Publication Data

US 2019/0376496 A1 Dec. 12, 2019

(30) Foreign Application Priority Data

Jun. 8, 2018 (DE) ..... 102018113677.3

(51) Int. Cl.
*F04B 17/03* (2006.01)
*F04B 23/04* (2006.01)

(52) U.S. Cl.
CPC ..... *F04B 17/03* (2013.01); *F04B 23/04* (2013.01)

(58) Field of Classification Search
CPC ..... F04B 17/03; F04B 23/04
USPC ..... 417/350, 423.6
See application file for complete search history.

(56) References Cited

U.S. PATENT DOCUMENTS 2,775,204 A * 12/1956 Batten ..... F04C 14/04 417/319
3,885,204 A * 5/1975 Abels ..... B60L 50/52 318/139
6,454,543 B1 9/2002 Beck et al.
6,860,726 B2 * 3/2005 Carter, III ..... B64D 41/00 417/319
8,151,965 B2 4/2012 Linortner et al.
8,572,958 B2 11/2013 Grethel et al.
8,740,582 B2 * 6/2014 Rabe ..... F25B 45/00 417/350

(Continued)

FOREIGN PATENT DOCUMENTS

CN 101386266 A 3/2009
CN 102414455 A 4/2012

(Continued)

OTHER PUBLICATIONS

Robert Sheaf, Bridge Circuit Provides One-Way Flow , Aug. 9, 2017.*

(Continued)

*Primary Examiner* — Christopher S Bobish
(74) *Attorney, Agent, or Firm* — RatnerPrestia

(57) ABSTRACT

A motor vehicle pump arrangement has a first pump and a second pump, and an electric motor for driving the two pumps. The electric motor is drive-connected fixedly to the first pump and connected via a clutch arrangement to the second pump, in such a way that the first pump can be driven on its own and the first and second pump can be driven together. The first pump is configured as a reversible pump which can be operated in two rotational directions. A valve arrangement generates a uniformly directed fluid volumetric flow which is independent of the rotational direction being provided for the first pump in a fluid circuit. The clutch arrangement is configured as a freewheeling clutch, via which the electric motor is drive-connected to the second pump.

12 Claims, 1 Drawing Sheet

(56) References Cited

U.S. PATENT DOCUMENTS

| | | | | |
|---|---|---|---|---|
| 9,243,532 | B2 * | 1/2016 | Ulrich | F01N 3/08 |
| 2010/0322791 | A1 * | 12/2010 | Wadsley | F04B 1/28 417/286 |
| 2014/0140864 | A1 | 5/2014 | Harten et al. | |
| 2015/0059328 | A1 * | 3/2015 | Suzuki | F15B 11/17 60/419 |

FOREIGN PATENT DOCUMENTS

| | | | | |
|---|---|---|---|---|
| CN | 204458342 | U | 7/2015 | |
| DE | 19514929 | A1 | 11/1995 | |
| DE | 10016782 | B4 | 11/2009 | |
| DE | 102011108535 | A1 | 1/2013 | |
| DE | 102012220742 | A1 | 5/2014 | |
| DE | 102016216264 | A1 | 3/2018 | |
| JP | 6487884 | A | 3/1989 | |
| JP | 2002081370 | A | 3/2002 | |
| WO | WO-2004107534 | A1 * | 12/2004 | H02K 7/10 |
| WO | 2011095148 | A2 | 8/2011 | |

OTHER PUBLICATIONS

Chinese Office Action for Chinese Application No. 201910491340.1, dated Aug. 26, 2020 with transaltion, 15 pages.

* cited by examiner

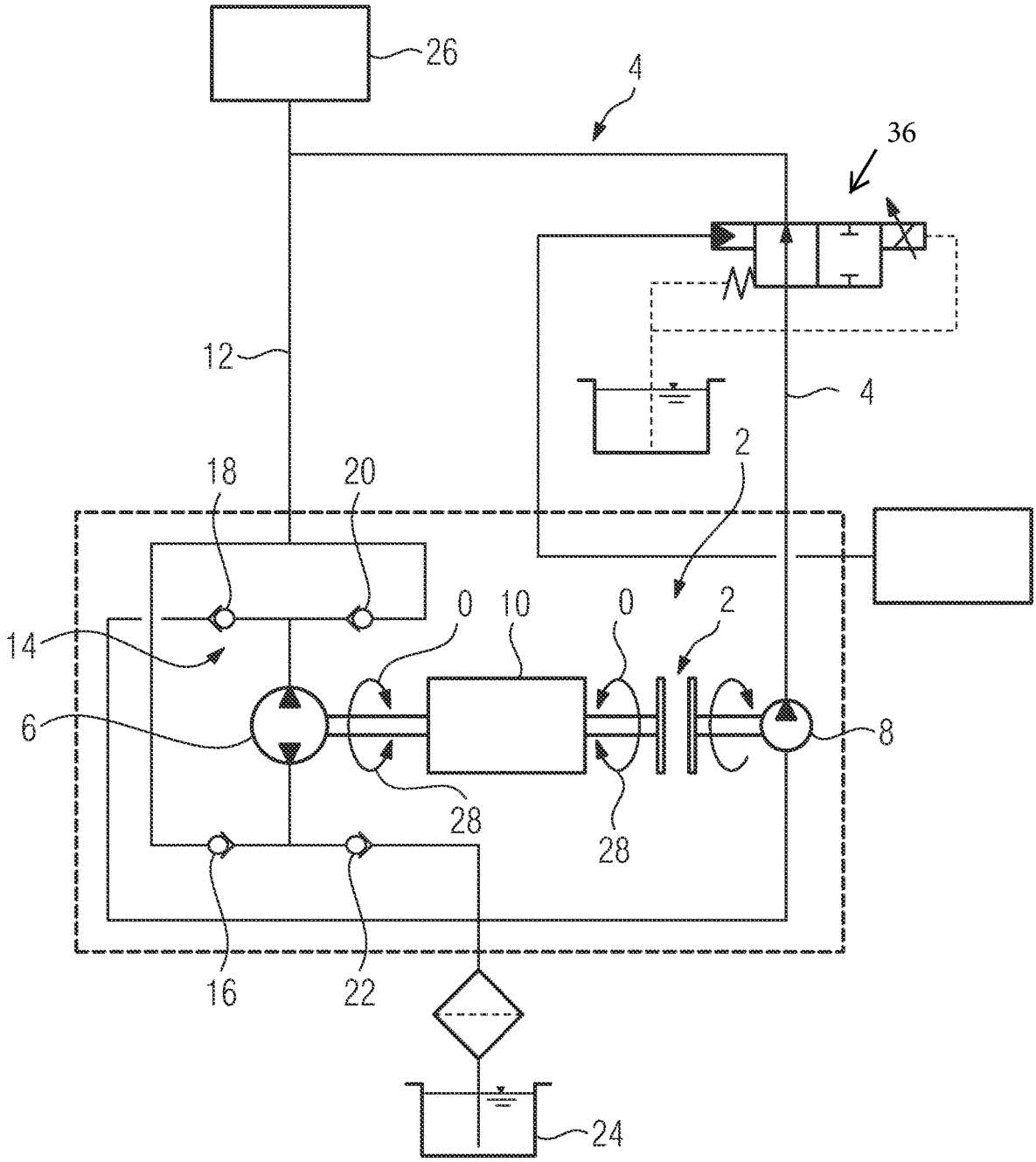
26
4
36
12
4
2
18
20
0
10
0
2
14
6
8
28
28
16
22
24

MOTOR VEHICLE PUMP ARRANGEMENT

CROSS-REFERENCE TO RELATED APPLICATION

This application claims priority to German Patent application No. DE 10 2018 113 677.3, filed Jun. 8, 2018, which is incorporated by reference herein in its entirety.

FIELD OF THE INVENTION

The invention relates to a motor vehicle pump arrangement having a first pump and a second pump, an electric motor for driving the two pumps being provided, the electric motor being drive-connected fixedly to the first pump and being connected via a clutch arrangement to the second pump, in such a way that the first pump can be driven on its own and the first and second pump can be driven together.

BACKGROUND OF THE INVENTION

Pumps of this type are known from the prior art. The hydraulic requirement of motor vehicle assemblies can be satisfied by way of a pump arrangement of this type. It is thus known within the context of the lubricating oil supply, for example, to provide a low pressure circuit and a high pressure circuit, the low pressure circuit being realized by way of a low pressure pump on its own, and the high pressure circuit being realized by way of a high pressure pump together with the low pressure pump. To this end, an electric motor drives the two pumps in every operating state, the high pressure circuit being enabled by way of a switchable valve arrangement. One disadvantage of said arrangement is that the power loss in the arrangement is very high as a result of the permanent driving of the high pressure pump. It is also conceivable to drive the two pumps by way of a single electric motor. A pump arrangement of this type is very expensive, however, since two electric motors have to be provided.

In this regard, international patent application WO 2011/095148, which is incorporated by reference herein, has disclosed the provision of a pump arrangement, in the case of which the second pump is connected via a switchable clutch to the electric motor. As a result of the provision of a switchable clutch, said pump arrangement is also expensive to acquire and complicated to produce. In addition, a control device has to be suitable for switching the clutch.

SUMMARY OF THE INVENTION

According to one aspect of the invention, a first pump is configured as a reversible pump which can be operated in two rotational directions, a valve arrangement for generating a uniformly directed fluid volumetric flow which is independent of the rotational direction being provided for the first pump in a fluid circuit, and the clutch arrangement being configured as a freewheeling clutch, via which the electric motor is drive-connected to the second pump. As a result, a motor vehicle pump arrangement is realized which is particularly simple, can therefore be produced inexpensively, and additionally requires a very small amount of installation space.

In one advantageous embodiment, the electric motor is arranged between the first and the second pump. As an alternative, the electric motor can also be arranged upstream of the first pump, the first pump being drive-connected via the freewheeling clutch to the second pump.

In an advantageous way, the first pump is configured as a low pressure pump and the second pump is configured as a high pressure pump. Stated differently, the second pump is configured as a higher pressure pump than the first pump.

As a result of the small required amount of installation space, the first and the second pump can be arranged in one housing and can be configured as a tandem pump.

In a particularly advantageous way, the first and the second pump are configured as transmission oil pumps.

In a particularly advantageous way, the valve arrangement is configured as a hydraulic bridge circuit with check valves. As a result, it is possible in a particularly simple way to provide a uniformly directed fluid volumetric flow.

BRIEF DESCRIPTION OF THE DRAWING

The sole FIGURE shows a diagrammatic view of the motor vehicle pump arrangement in a low pressure circuit and in a high pressure circuit.

DETAILED DESCRIPTION OF THE INVENTION

The FIGURE shows a motor vehicle pump arrangement 2 according to aspects of the invention in a fluid circuit 4. The motor vehicle pump arrangement 2 is configured as a tandem pump in a housing (not shown explicitly). This tandem pump 2 is used as a transmission oil pump in a lubricating oil circuit 4. To this end, the motor vehicle pump arrangement 2 has a first pump 6 and a second pump 8 which can both be driven by way of an electric motor 10 which is arranged between the two pumps 6, 8.

Here, the first pump 6 is configured as a reversible pump and as a low pressure pump. Here, the low pressure pump 6 which is drive-connected fixedly to the electric motor 10 delivers in a manner which is dependent on the rotational direction of the electric motor 10. In order then for a uniformly directed fluid volumetric flow which is independent of the rotational direction to be realized in the fluid circuit 4 and, in particular, in a low pressure circuit 12, a valve arrangement 14 which is configured as a hydraulic bridge circuit is provided. Said valve arrangement 14 comprises four check valves 16, 18 and 20, 22 which are arranged in such a way that they firstly make an intake of fluid from a fluid reservoir 24 possible, and secondly ensure the pumping of a fluid to a motor vehicle auxiliary unit 26 (here, a transmission). Thus, in the case of a first rotational direction 28 of the electric motor 10, the check valve 16 acts as a delivery valve and the check valve 18 acts as an intake valve. In the case of a second rotational direction 30 of the electric motor 10, the check valve 20 acts as a delivery valve and the check valve 22 acts as an intake valve.

The second pump 8 which is configured as a high pressure pump is arranged on that side of the electric motor 10 which lies opposite the low pressure pump 6. Said high pressure pump 8 is drive-connected to the electric motor 10 via a clutch arrangement 32 which is configured as a freewheeling clutch. This means that the high pressure pump 8 is not driven in the case of a first rotational direction 28 of the electric motor 10. The high pressure pump 8 is also driven and sucks in fluid from the fluid reservoir 24 and pumps it into a high pressure fluid circuit 34 merely when the electric motor 10 is operated in the second rotational direction 30. In order for it to be possible for the feed of the fluid from the high pressure circuit 34 in the direction of the low pressure circuit 12 to be controlled, another switchable valve 36 which is known per se is provided in the present exemplary embodiment.

In particular, the arrangement of the electric motor is not restricted to the present exemplary embodiment.

What is claimed is:

1. A motor vehicle pump arrangement comprising:

a first pump (i) configured as a reversible pump which is configured to be operated in two rotational directions and (ii) configured to be connected to a fluid reservoir for drawing fluid from the fluid reservoir;

a second pump configured to be connected to the fluid reservoir by a first fluid line for drawing fluid from the fluid reservoir;

an electric motor for driving the first and second pumps, the electric motor being drive-connected fixedly to the first pump and being connected via a clutch arrangement to the second pump, in such a way that the first pump can be driven independently and the first and second pump can be driven together, wherein the clutch arrangement is configured as a freewheeling clutch, via which the electric motor is drive-connected to the second pump;

a valve arrangement configured for generating a uniformly directed fluid volumetric flow which is independent of the rotational direction provided for the first pump in a fluid circuit;

wherein the first pump has two ports, and one port of the two ports is fluidly connected to a first set of check valves of the valve arrangement, and the other port of the two ports is fluidly connected to a second set of check valves of the valve arrangement, wherein, each set of check valves includes two check valves, and in a first rotational direction of the first pump, one check valve of the first set of check valves acts a delivery valve and one check valve of the second set of check valves acts as an intake valve, and in a second rotational direction of the first pump, the other check valve of the first set of check valves acts an intake valve and the other check of the second set of check valves acts as a delivery valve, wherein the first set of check valves are fluidly connected together by a second fluid line, and the second set of check valves are fluidly connected together by a third fluid line, wherein the first, second and third fluid lines are fluidly connected together at an intersection located between the fluid reservoir and the first and second pumps, wherein the second and third fluid lines are connected to a fourth fluid line at a second intersection, wherein the fourth fluid line is configured to be connected to a vehicle auxiliary unit, a fifth fluid line fluidly interconnecting the second pump and the fourth fluid line, wherein a connection between the fourth and fifth fluid lines is arranged downstream of the second intersection, and a switchable valve connected to the fifth fluid line, wherein a control portion of the switchable valve is connected to a location other than the fourth fluid line.

2. The motor vehicle pump arrangement as claimed in claim 1, wherein the electric motor is arranged between the first and the second pump.

3. The motor vehicle pump arrangement as claimed in claim 1, wherein the electric motor is arranged on a common side of the first pump and the second pump, the first pump being drive connected to the second pump via the freewheeling clutch.

4. The motor vehicle pump arrangement as claimed in claim 1, wherein the first pump is configured as a low pressure pump and the second pump is configured as a high pressure pump.

5. The motor vehicle pump arrangement as claimed in claim 1, wherein the first and the second pump are arranged in one housing and configured as a tandem pump.

6. The motor vehicle pump arrangement as claimed in claim 1, wherein the first and the second pump are each configured as transmission oil pumps.

7. The motor vehicle pump arrangement as claimed in claim 1, wherein the valve arrangement is configured as a hydraulic bridge circuit.

8. The motor vehicle pump arrangement as claimed in claim 1, wherein the first and second sets of check valves are fluidly connected in series.

9. A motor vehicle pump arrangement for supplying fluid from a fluid reservoir to a vehicle auxiliary unit, the motor vehicle pump arrangement comprising:

a first pump (i) configured as a reversible pump which is configured to be operated in two rotational directions and (ii) configured to be connected to the fluid reservoir for drawing fluid from the fluid reservoir;

a second pump configured to be connected to the fluid reservoir by a first fluid line for drawing fluid from the fluid reservoir;

an electric motor for driving the first and second pumps, the electric motor being drive-connected fixedly to the first pump and being connected via a clutch arrangement to the second pump, in such a way that the first pump can be driven independently and the first and second pump can be driven together, wherein the clutch arrangement is configured as a freewheeling clutch, via which the electric motor is drive-connected to the second pump;

a valve arrangement configured for generating a uniformly directed fluid volumetric flow which is independent of the rotational direction provided for the first pump in a fluid circuit;

wherein the first pump has two ports, and one port of the two ports is fluidly connected to a first set of check valves of the valve arrangement, and the other port of the two ports is fluidly connected to a second set of check valves of the valve arrangement, wherein, each set of check valves includes two check valves, and in a first rotational direction of the first pump, one check valve of the first set of check valves acts a delivery valve and one check valve of the second set of check valves acts as an intake valve, and in a second rotational direction of the first pump, the other check valve of the first set of check valves acts an intake valve and the other check of the second set of check valves acts as a delivery valve, wherein the first set of check valves are fluidly connected together by a second fluid line, and the second set of check valves are fluidly connected together by a third fluid line, and wherein the second and third fluid lines are connected to a fourth fluid line at a first intersection, wherein the fourth fluid line is configured to be fluidly connected to the vehicle auxiliary unit, a fifth fluid line fluidly interconnecting the second pump and the fourth fluid line, wherein a connection between the fourth and fifth fluid lines is arranged downstream of the first intersection, and a switchable valve connected to the fifth fluid line, wherein a control portion of the switchable valve is connected to a location other than the fourth fluid line.

10. The motor vehicle pump arrangement of claim 9, wherein the first, second and third fluid lines are fluidly connected together at a second intersection located between the fluid reservoir and the first and second pumps.

11. The motor vehicle pump arrangement of claim 9, wherein said connection between the fourth and fifth fluid lines is arranged between the first intersection and the vehicle auxiliary unit.

12. The motor vehicle pump arrangement of claim 9 further comprising the vehicle auxiliary unit.

* * * * *